US005431543A

United States Patent [19]

Brown et al.

[11] Patent Number: 5,431,543

[45] Date of Patent: Jul. 11, 1995

[54] TURBINE BLADE LOCKING ASSEMBLY

[75] Inventors: Wilmott G. Brown, Winter Park; Daniel E. Ford, Christmas, both of Fla.

[73] Assignee: Westinghouse Elec Corp., Pittsburgh, Pa.

[21] Appl. No.: 236,440

[22] Filed: May 2, 1994

[51] Int. Cl.[6] ..... F01Q 5/32

[52] U.S. Cl. ..... 416/221; 416/220 R; 29/889.21

[58] Field of Search ..... 416/219 R, 220 R, 221, 416/248, 500, 206; 29/889.1, 889.21

[56] References Cited

U.S. PATENT DOCUMENTS 4,265,595 5/1981 Bucy, Jr. et al. ..... 416/221

5,236,309 8/1993 Van Heusden et al. ..... 416/221

*Primary Examiner*—Edward K. Look

*Assistant Examiner*—Christopher Verdier

*Attorney, Agent, or Firm*—M. G. Panian; G. R. Jarosik

[57] ABSTRACT

A turbine blade assembly is provided which comprises a rotor which is rotatable about a turbine axis of rotation and a plurality of turbine blades supported by the rotor where each of the turbine blades has a root and the rotor is provided with a plurality of grooves which terminate in a projection. Each groove is shaped for holding each root in a manner such that the root and the groove have mutually contacting surfaces which apply a radially inwardly directed restraining force to the root. The root has a bottom facing the turbine axis and the groove has a base which is located radially inwardly of, and faces, the root bottom. Positioned between the root bottom and the groove base is a lock strip and disc spring assembly for pressing together the mutually contacting surfaces of the root and the groove. Inserted adjacent the lock strip, for further pressing together the mutually contacting surfaces of the root and the groove, is a shim comprising a first resilient projection engageable with the lock strip for preventing expulsion of the shim from between the root bottom and the groove base and a second resilient projection engageable with a back wall of the blade root for preventing the shim from migrating towards the center of the root.

5 Claims, 2 Drawing Sheets

FIG. 1
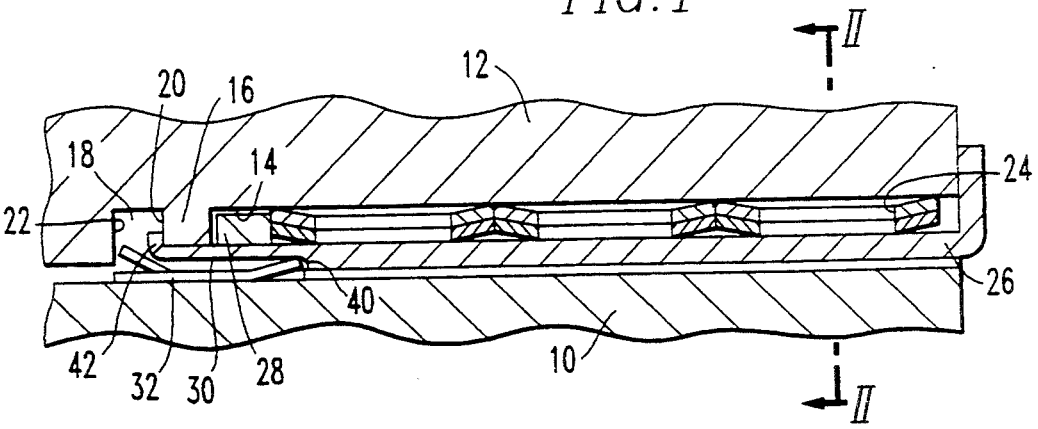
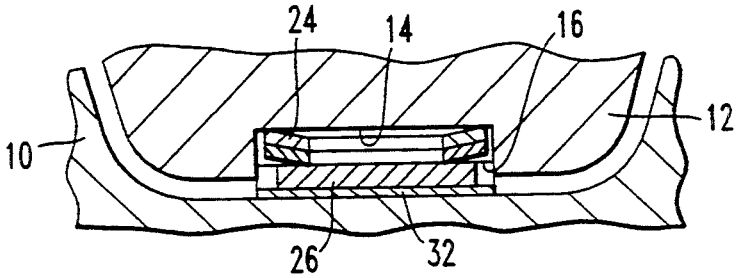
FIG. 2
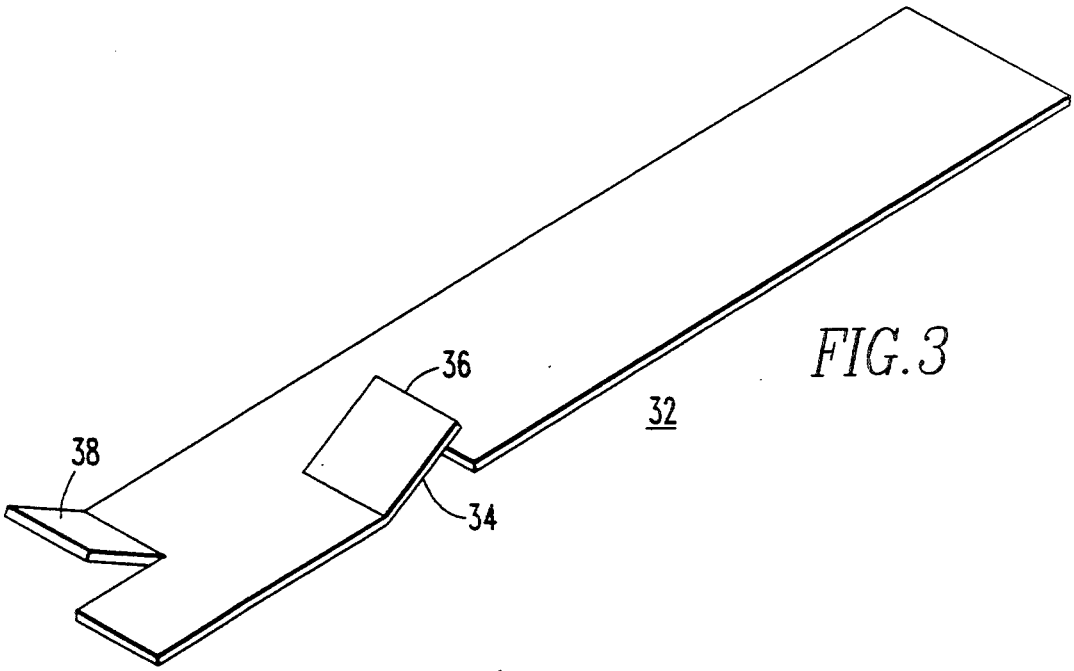
FIG. 3

TURBINE BLADE LOCKING ASSEMBLY

BACKGROUND OF THE INVENTION

The present invention relates to the fabrication of turbine blade assemblies and, in particular, to an improved shim for controlling turbine blade motion.

A typical turbine blade row is composed of a plurality of individual blades which are installed in a support member, typically an annular rotor or hub. The conventional turbine blade includes a root portion by which the blade is connected to the hub in a free-standing manner whereby each blade is supported only at this connection. When blades are assembled to the hub, movement of each blade relative to the hub in the tangential direction of the rotor must be eliminated to the greatest extent possible. Typically, when a turbine is rotating at high speed, centrifugal forces act to stabilize the position of each blade relative to the hub. However, at lower speeds, such as turning gear speeds, there is a tendency for the blade roots to move circumferentially within their respective rotor grooves. Specifically, as the turbine assembly rotates, points will be reached at which the blade is acted upon by gravity such that the root will tend to shift within its associated rotor groove. Such movement of the blade roots may cause an effect known as "fretting" in which particles are worn from surfaces which rub together which particles may oxidize and harden whereby they can abrade the blade root and associated rotor groove bearing surfaces. Loose fitting blades therefore have the potential to reduce the useful blade life in the root area due to fatigue.

For this reason, efforts have been made to prevent such relative motion between the blade root and its associated rotor groove. An example of one such effort may be found in U.S. Pat. No. 5,236,309 to Van Heusden et al., issued Aug. 17, 1993, assigned to the assignee of the present invention, and incorporated herein by reference. The '309 patent, as exemplified by FIG. 4, teaches utilizing belleville spring washers 8' compressed between the root bottom 12' and the groove base rotor 10' to keep the contacting surfaces in tight fitting arrangement. This has been found effective in controlling the problem, however, it has been noted that shims currently in use as an aide to the spring washers have the potential of slipping from their place of engagement between the spring washers and groove base whereby the rotor blade once again may become loose within the groove thereby subjecting the machine to damage caused by fretting. This is particularly true in that there currently is no discernable way on ensuring that the shim has been properly installed between the disc spring and the rotor groove base.

Therefore, an object of the present invention is to provide a shim design which will ensure that the shim will not become expelled during operation whereby the blade may become loose within the operating machine.

A further object of the present invention is to provide a discernable signal during assembly whereby confirmation of correct installation of the shim may be made.

SUMMARY OF THE INVENTION

In accordance with the present invention, a turbine blade assembly is provided. The turbine blade assembly comprises a rotor which is rotatable about a turbine axis of rotation and a plurality of turbine blades supported by the rotor where each of the turbine blades has a root and the rotor is provided with a plurality of grooves which terminate in a projection. Each groove is shaped for holding each root in a manner such that the root and the groove have mutually contacting surfaces which apply a radially inwardly directed restraining force to the root. The root has a bottom facing the turbine axis and the groove has a base which is located radially inwardly of, and faces, the root bottom. Positioned between the root bottom and the groove base is a lock strip, having a lip engageable with the projection, for pressing together the mutually contacting surfaces of the root and the groove. Inserted adjacent the lock strip, for further pressing together the mutually contacting surfaces of the root and the groove, is a shim comprising a first resilient projection engageable with the lock strip for preventing expulsion of the shim from between the root bottom and the groove base and a second resilient projection engageable with the root bottom for preventing migration of the shim towards the center of the rotor groove.

A better understanding of the objects, advantages, features, properties and relationships of the invention will be obtained from the following detailed description and accompanying drawings which set forth an illustrative embodiment and is indicative of the various ways in which the principles of the invention may be employed.

BRIEF DESCRIPTION OF THE DRAWINGS

For a better understanding of the invention, reference may be had to the preferred embodiment shown in the following drawings in which:

FIG. 1 shows a cross sectional view illustrating a blade assembly in which the blade root is supported in a rotor groove by the subject invention;

FIG. 2 shows a cross sectional view along line II—II of FIG. 1; and

FIG. 3 shows an perspective view of the shim utilized in the subject invention.

DESCRIPTION OF THE PREFERRED EMBODIMENT

Figure 4:
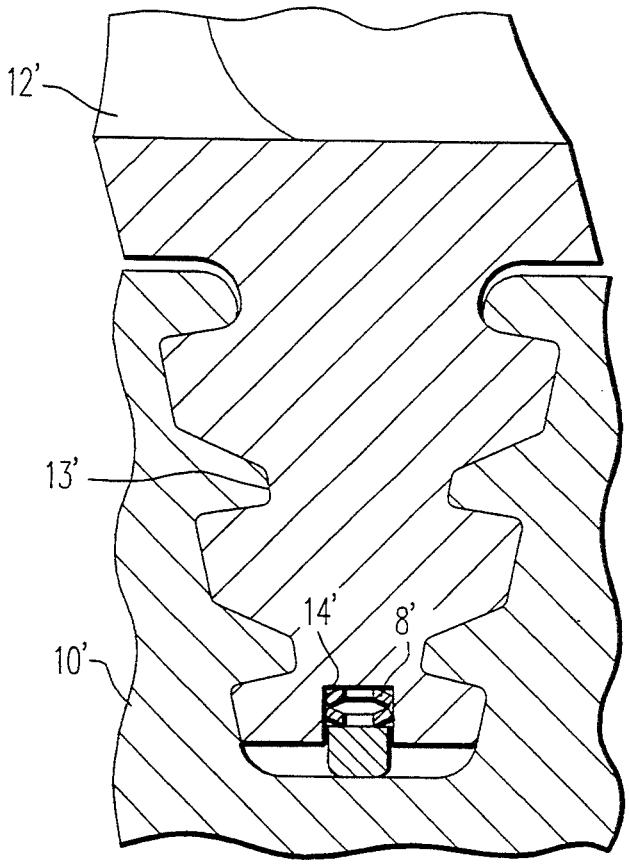
FIG. 4 PRIOR ART
FIG. 4 is a cross-sectional view illustrating a prior art blade assembly

While the invention can be used in machinery having parts mounted on rotating members, it will be described hereinafter in the context of a turbine as the preferred embodiment thereof.

Referring now to the FIGS. 1 and 2, wherein like reference numerals refer to like elements, shown is part of a turbine including a turbine rotor 10 and a turbine blade root 12. In order to hold each blade in place, the blade root and associated groove in the rotor are provided with matching cross sections characterized by serrated, serpentine, or dentate edges 13' (FIG. 4) such that, when each blade is inserted into the rotor by driving its root along the associated groove parallel to the turbine axis, the serrated surfaces engage for use in preventing movement of the turbine blade. At each edge of blade root 12, the blade root bottom is formed with a groove 14 which extends from the associated blade edge. The end of the groove 14 remote from the associated blade edge terminates at a projection, or ledge 16. The base, or bottom surface, or ledge 16 is positioned at a higher level, i.e. is spaced a greater distance from the rotor groove bottom, than is the blade root bottom. Behind the ledge 16 there is a recess, or channel, 18 which may extend across the entire width of root 12 perpendicular to the plane of FIG. 1. Recess 18 has a front wall 20 and a root rear wall 22.

The contacting surfaces of blade root 12 are held in tight fitting arrangement with the associated groove of rotor 10 through the use of disc springs or belleville spring washers 24 and a lock strip 26 provided to lock disc spring 24 in place relative to root 12. The disc spring 24 are held in place by the side walls groove 14, by ledge 16, and by the bent-up free end of strip 26. Depending upon the number and diameter of the disc spring 24, they may further held in place by a filler piece 28. Typically, if the number of disc spring stacks, or the diameter of the disc springs, is reduced, a larger filler piece 28 is employed. For smaller roots, the filler piece 28 may be eliminated.

The rear, or the interior, end of the lock strip 26 is undercut to form a recess 30 so that lock strip 26 has a thin end portion spaced from the groove bottom by recess 30.

Provided beneath each lock strip 26 is a shim 32 typically constructed of spring steel, tool steel, hardened stainless steel, or similar durable, resilient material. Shim 32 will be given a thickness selected to produce the desired degree of compression of disc springs 24. It is preferred that the shims 32 range from 5 to 30 mils in thickness whereby the shims 32 may be stacked to fulfill tolerance requirements which allows the more expensive lock strip to be manufactured in one thickness.

Turning to FIG. 3, the shim 32 is provided with at least one raised spring portion 34 created by bending upward a portion of shim 32 after shim 32 has been cut. The cutting may be performed by hot wire EDM, laser cutting, or by punching. The spring portion 34 is positioned upon shim 32 such that it will be positioned within recess 30 when the shim 32 is inserted in the blade assembly. Furthermore, the spring portion 34 is formed to create an incline consistent with the direction of insertion whereby edge 36 will be raised toward the exterior of slot 14. The shim 32 may also be provided with at least one raised spring portion 38, formed in a similar manner to spring portion 34, preferably having the opposite inclination. Spring portion 34 is provided to prevent expulsion of the shim while spring portion 38 is provided to prevent migration of the shim towards the center of the root. The length of the shim 32 is inconsequential as any excess may be trimmed after insertion into the blade assembly. Furthermore, for smaller roots, the end of shim 32 may be tapered on both sides from the vicinity of spring portion edge 36 towards spring portion 38 to aide in fitting owing to the curvature of the groove.

Preferably, recess 30 is dimensioned so that the end portion of lock strip 26 has a thickness less than one-half that of the remainder of the strip 26, and a length, toward the associated blade assembly edge, such that the inner end portion does not extend beneath the hole at the center of the stack of disc springs 24 which are furnished from the associated blade assembly edge. The inner end portion terminates at an edge 40 about which lock strip 26 is pivoted during installation.

Installation of the blade with the above described motion restraining arrangement is accomplished by first inserting blade root 12 into the groove in rotor 14 by advancing root 12 between the inlet and outlet edges of the blade assembly. As discussed, the walls of root 12 and the groove are shaped so that the root 12 slides easily into the groove and is somewhat restrained from motion.

Next, the locking strip 26 is inserted from each blade assembly edge. At this time, the outer end of each lock strip 26 is straight. To insert lock strip 26, lock strip 26 is tilted to allow lip 42 to pass under ledge 16. Then, the lock strip 26 is tilted back into the locked position shown in FIG. 1. At this point, the appropriate number of shims 32 are introduced into the rotor groove under the lock strip 26. Insertion is again performed by driving the shims 32 in the open groove 14. Complete insertion of the shims 32 is noted by a distinctive audible snap as the spring portion 36 of the shims releases from under the strip 26 and snaps against the raised portion of strip 26 which creates recess 30. At this point, the shims 32 become self locking in that the spring portion 36 will interact with the edge 40 of the strip 26 to prevent expulsion of the shim 32 from under the strip 26 during rotor operation. Spring portion 38 will interact with back wall surface 22 to prevent migration of the shim towards the center of the rotor groove.

Filler 28 and stacks of disc springs 24 are then inserted above each strip 26. Again, filler 28 may not be required. Insertion may be performed by sliding filler 28 and each stack of disc springs 24 in via the open end of groove 14. The disc springs 24 are preferably oriented so that the inner edge of the lowermost disc spring 24 in each stack contacts lock strip 26 and the outer edge of the uppermost disc spring 24 in each stack contacts the bottom of groove 14. After insertion of the filler 28 and the disc springs 24, the end of lock strip 26 is bent up to lock the filler 28 and disc spring 24 in place relative to root 12 and any excess length of shim material is removed.

It should be apparent from the preceding description that this invention has among other advantages, the advantage providing and maintaining a tight fitting arrangement between the blade root and the rotor groove whereby fretting may be minimized. Furthermore, the self-locking shim provided has the advantage of eliminating expulsion of the pieces used in the locking arrangement during operation which has the potential causing blade and general machine damage.

It is to be understood that the descriptions and drawings shown with respect to the present invention are not limiting and that other rotor blade assembly arrangements utilizing the concepts of the self locking shim present in this disclosure are contemplated.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any equivalent thereof.

We claim:

1. A turbine blade assembly, comprising:

a rotor which is rotatable about a turbine axis of rotation;

a plurality of turbine blades supported by the rotor, each of the turbine blades having a root and the rotor being provided with a plurality of grooves where each groove is shaped for holding each root in a manner such that the root and the groove have mutually contacting surfaces which apply a radially inwardly directed restraining force to the root, the root further having a bottom facing the turbine axis and the groove having a base which is located radially inwardly of, and faces, the root bottom;

a lock strip having a lip, said lock strip being positioned between the root bottom and the groove base for pressing together the mutually contacting surfaces of the root and the groove such that the lip engages the groove, the lock strip having a strip surface which is undercut to create a recess between the strip surface and the groove base; and a shim, inserted adjacent the lock strip for further pressing together the mutually contacting surfaces of the root and the groove, the shim comprising a first resilient spring portion which expands in the recess to cooperate with the strip surface for preventing expulsion of the shim from between the root bottom and the groove base, and a second securing means for preventing the shim from migrating further into the groove.

2. The rotor assembly of claim 1, wherein the groove terminates at a projection with which the lip engages.

3. The rotor assembly of claim 1, wherein the strip surface is undercut in proximity to the lip and wherein the second securing means comprises a second resilient spring portion which expands in the recess in order make contact with a back surface of the root for preventing the shim from migrating further into the groove.

4. A method for securing a rotor blade, having a root portion, on a rotor, having a groove, the rotor being rotatable about a turbine axis, wherein the groove is shaped for holding the root such that the root and the groove have mutually contacting surfaces which apply a radially inwardly directed restraining force on the root, the root further having a bottom facing the turbine axis and the groove having a base which is located radially inwardly of, and faces, the root bottom, the method comprising:

inserting the root into the groove;

disposing between the root bottom and the groove base a pressing means for pressing together the mutually contacting surfaces of the root and the groove; and inserting adjacent to the pressing means a shim, having a first resilient securing means, to a point where the first resilient securing means engages a surface of the pressing means as the first securing means expands to fill a recess, created between the pressing means and the groove base after the pressing means is disposed thereon, for preventing expulsion of the shim.

5. A turbine blade assembly, comprising:

a rotor which is rotatable about a turbine axis of rotation;

a plurality of turbine blades supported by the rotor, each of the turbine blades having a root and the rotor being provided with a plurality of grooves, where each groove is shaped for holding each root and terminates in a projection, in a manner such that the root and the groove have mutually contacting surfaces which apply a radially inwardly directed restraining force to the root, the root further having a bottom facing the turbine axis and the groove having a base which is located radially inwardly of, and faces, the root bottom;

a lock strip, having a lip engageable with the projection, positioned between the root bottom and the groove base;

a plurality of disc springs disposed between the lock strip and the root bottom for pressing together the mutually contacting surfaces of the root and the groove; and a shim, inserted adjacent the lock strip for further pressing together the mutually contacting surfaces of the root and the groove, the shim comprising a first resilient projection engageable with the lock strip for preventing expulsion of the shim from between the root bottom and the groove base and a second resilient projection engageable with a back surface wall of the root for preventing further movement of the shim into the groove.

* * * * *